US006371214B1

(12) United States Patent
Anwar et al.

(10) Patent No.: US 6,371,214 B1
(45) Date of Patent: Apr. 16, 2002

(54) METHODS FOR AUTOMATING WORK MACHINE FUNCTIONS

(75) Inventors: Sohel Anwar, Canton, MI (US); Sabri Cetinkunt, Oak Park, IL (US); Chenyao Chen, Glenview, IL (US); Richard G. Ingram, Saint Charles, IL (US); Unnat Pinsopon, Bangkok (TH)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/575,778

(22) Filed: May 22, 2000

Related U.S. Application Data

(60) Provisional application No. 60/138,904, filed on Jun. 11, 1999.

(51) Int. Cl.[7] ..... A01B 63/112
(52) U.S. Cl. ..... 172/1; 701/50
(58) Field of Search ..... 37/348; 172/1, 172/2, 3, 4, 4.5, 7–12; 701/50; 414/699, 700, 697; 91/361, 367, 453, 461

(56) References Cited

U.S. PATENT DOCUMENTS 4,934,463 A 6/1990 Ishida et al.
5,052,883 A 10/1991 Morita et al.
5,077,973 A 1/1992 Suzuki et al.
5,088,020 A 2/1992 Nishida et al.
5,188,502 A * 2/1993 Tonsor et al. ..... 414/700
5,189,940 A * 3/1993 Hosseini et al. ..... 91/361
5,224,033 A 6/1993 Nakamura et al.
5,333,533 A * 8/1994 Hosseini ..... 91/361
5,446,980 A 9/1995 Rocke
5,469,921 A * 11/1995 Orbach et al. ..... 172/4
5,528,843 A 6/1996 Rocke
5,549,166 A * 8/1996 Orbach et al. ..... 172/4
5,685,377 A 11/1997 Arstein et al.
5,701,793 A 12/1997 Gardner et al.
5,737,993 A 4/1998 Cobo et al.
6,076,612 A * 6/2000 Carr et al. ..... 172/7

* cited by examiner

*Primary Examiner*—Robert E. Pezzuto
(74) *Attorney, Agent, or Firm*—Liza J. Meyers; David M. Masterson

(57) ABSTRACT

A control system implements several methods for automating work functions of a machine. Single activation of an operator switch generates a command to automatically perform a desired work function. A controller determines whether conditions are satisfactory to perform the desired function. When the conditions are satisfactory, the work function is performed automatically without requiring the operator to manipulate levers that are otherwise used to control the work implement of the machine.

22 Claims, 10 Drawing Sheets

METHODS FOR AUTOMATING WORK MACHINE FUNCTIONS

This application claims the benefit of prior provisional patent application Serial No. 60/138,904 filed Jun. 11, 1999.

TECHNICAL FIELD

This invention generally relates to a system and method for controlling work machine functions and, more particularly to methods for automating work machine functions that are performed on a repetitive basis.

BACKGROUND ART

A variety of work machines are utilized for construction and excavation work. Examples of such machines include excavators, wheel loaders, front shovels and front end loaders. Each one of these types of machines includes a work implement so that a variety of tasks can be performed. The work implement is supported by a plurality of linkages.

The machine operator typically uses a plurality of levers to manipulate the work implement and supporting linkage into a variety of positions to perform the various tasks that are required on a typical earth moving job. A major shortcoming of current arrangements is that the operator typically experiences fatigue from the repetitive and continuous movement of the levers to perform various work functions on a job site. This is especially true when certain functions are repeated many times during a typical work day.

Another shortcoming of conventional arrangements is that an operator must be highly skilled in order to accurately and efficiently perform the various work functions using the work machine. The size, power and expense of typical work machines requires a highly skilled operator to avoid potential damage to the machine or other equipment on a job site. An operator also must develop skills at manipulating the plurality of levers in specific sequences and with specific timing in order to efficiently perform various work functions.

There is a need for simplifying the tasks of operating heavy duty work machinery. Minimizing operator fatigue will not only improve working conditions for the operator, but will also enhance the efficient use of the work machinery during a typical day.

This invention addresses that need by providing a system and control methods for automating certain work functions.

DISCLOSURE OF THE INVENTION

In general terms, this invention is a system for automating work machine functions. The work machine includes a work implement that is supported by a plurality of linkages and is moveable into a plurality of positions to accomplish necessary work functions. The work machine includes an operator interface that has at least one operator switch that is selectively activated by the operator to generate a command to automate a desired work function. A system controller interprets the command from the operator switch and determines whether preselected conditions necessary to perform the desired work function exist. Once the controller has confirmed that the necessary conditions have been met, the controller controls the work machine so that the desired work function is performed automatically responsive to the single switch activation by the operator.

In another aspect of this invention, the system controller determines when the work implement is within a predetermined range of positions, which may introduce undesirable machine performance. The system controller modifies the operator switch signals for moving the work implement through the predetermined range such that the work machine is stabilized while performing the desired work function.

The various features and advantages of this invention will become apparent to those skilled in the art from the following detailed description of the currently preferred embodiments. The drawings that accompany the detailed description can be briefly described as follows.

BRIEF DESCRIPTION OF THE DRAWINGS

FIGS. 6A and 6B are flow chart diagrams illustrating a second method of this method.

BEST MODE FOR CARRYING OUT THE INVENTION

Figure 1:
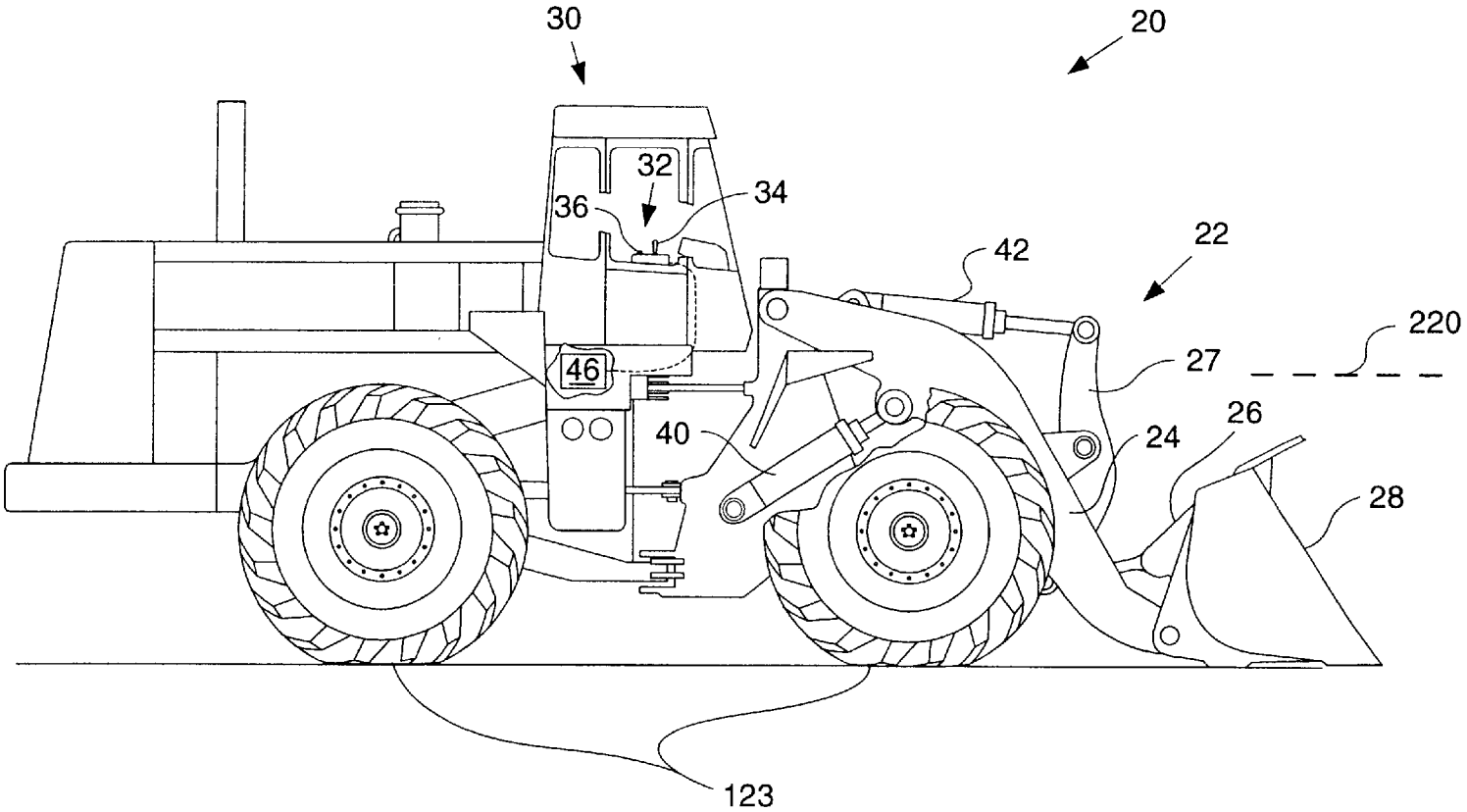
FIG. 1 is a diagrammatic illustration of a work machine including a control system designed according to this invention.

FIG. 1 diagrammatically illustrates a heavy duty work machine 20. The illustrated work machine is commonly referred to as a wheel loader. It is important to note that this invention is not limited to use with wheel loaders. A variety of work machines that require movement of more than one component to complete a work function can be operated using the system and methods of this invention. Other types of machines for which this invention is useful include track loaders, excavators, and the like.

The machine 20 includes a work implement 22 having moveable members that are moveable into a variety of positions to perform various work functions and rotary members 123 which serve as a motive means for the machine. The work implement 22 includes a lift arm 24, bucket link 26, lever link 27 and a work attachment 28, shown here as a bucket.

The work implement 22 is supported by the machine body portion 30, which houses the engine and supports an operator compartment. A control panel 32 is positioned within the operator compartment so that the operator can manipulate a plurality of levers 34 to move the work implement 22 through a series of positions to perform desired work functions. The control panel 32 designed according to this invention also includes at least one operator switch 36 for performing automated work functions as will be described below.

Figure 2:
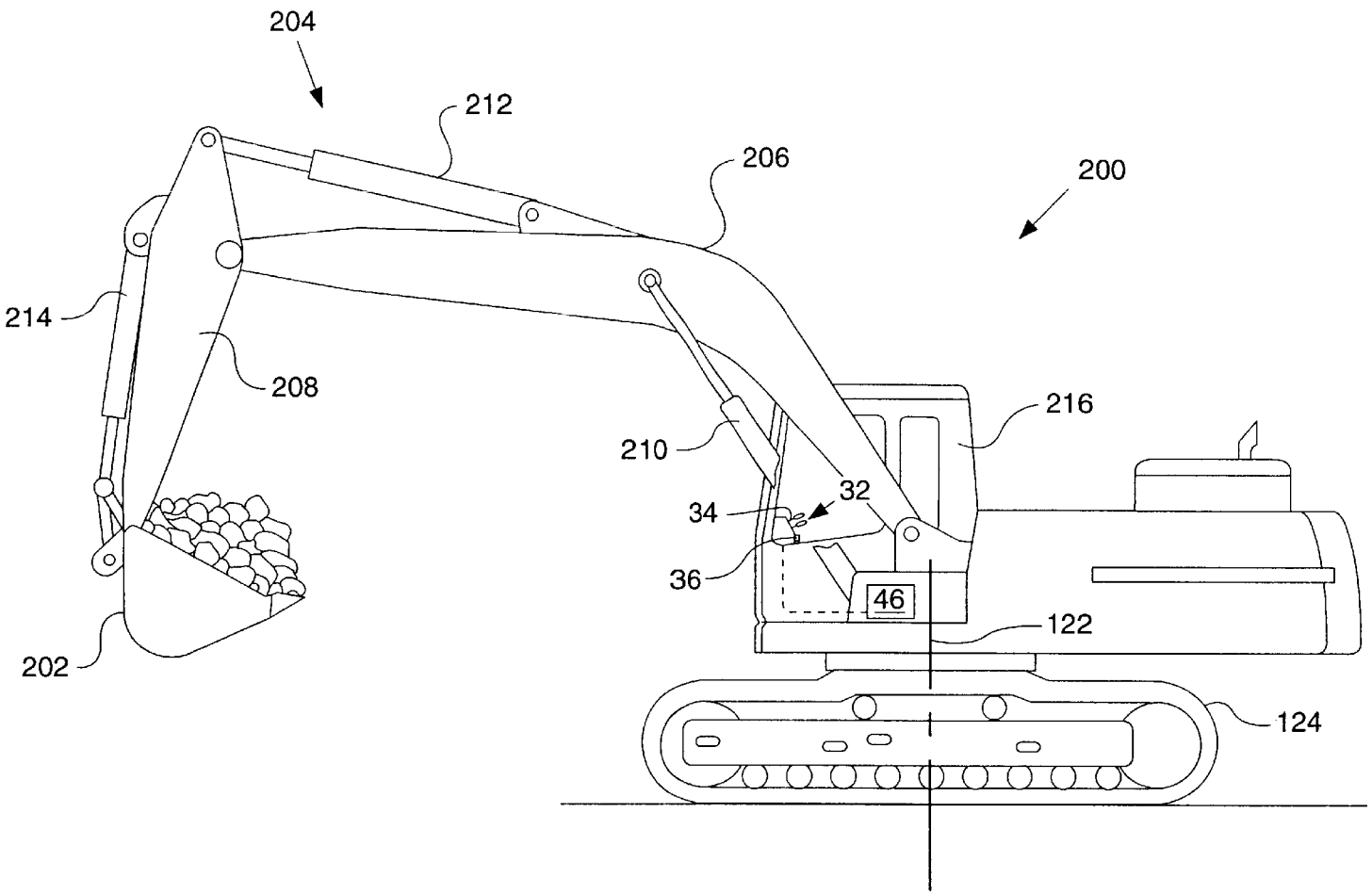
FIG. 2 is a diagrammatic illustration of another work machine that can be operated using the methods of this invention.

The lift arm 24 is moved relative to the machine body portion 30 by hydraulic cylinder 40, which is normally controlled by movement of one of the dedicated levers 34. Similarly, the lever link 27 is moved relative to the lift arm 24 through hydraulic cylinder 42 and the work attachment 28 is moved relative to the lift arm 24 through hydraulic cylinder 42, bucket link 26, and lever link 27. The operator control panel 32 includes a plurality of levers 34, each of which preferably enables the operator to control the operation of a respective one of the hydraulic cylinders 40,42 for manipulating the work implement 22 as required to perform a desired work function. Similar control functions are performed on excavators, an example of which is shown in FIG. 2. FIG. 2 is an illustrative example of a hydraulic excavator. The work machine 200 consists of a machine body 216 which is rotatably mounted on a rotary track 124, and work implement 204. The work implement 204 includes a boom 206, stick 208, and a work attachment 202, as well as hydraulic cylinders 210, 212, and 214 which manipulate the boom 206, stick 208, and work attachment 202.

Figure 3:
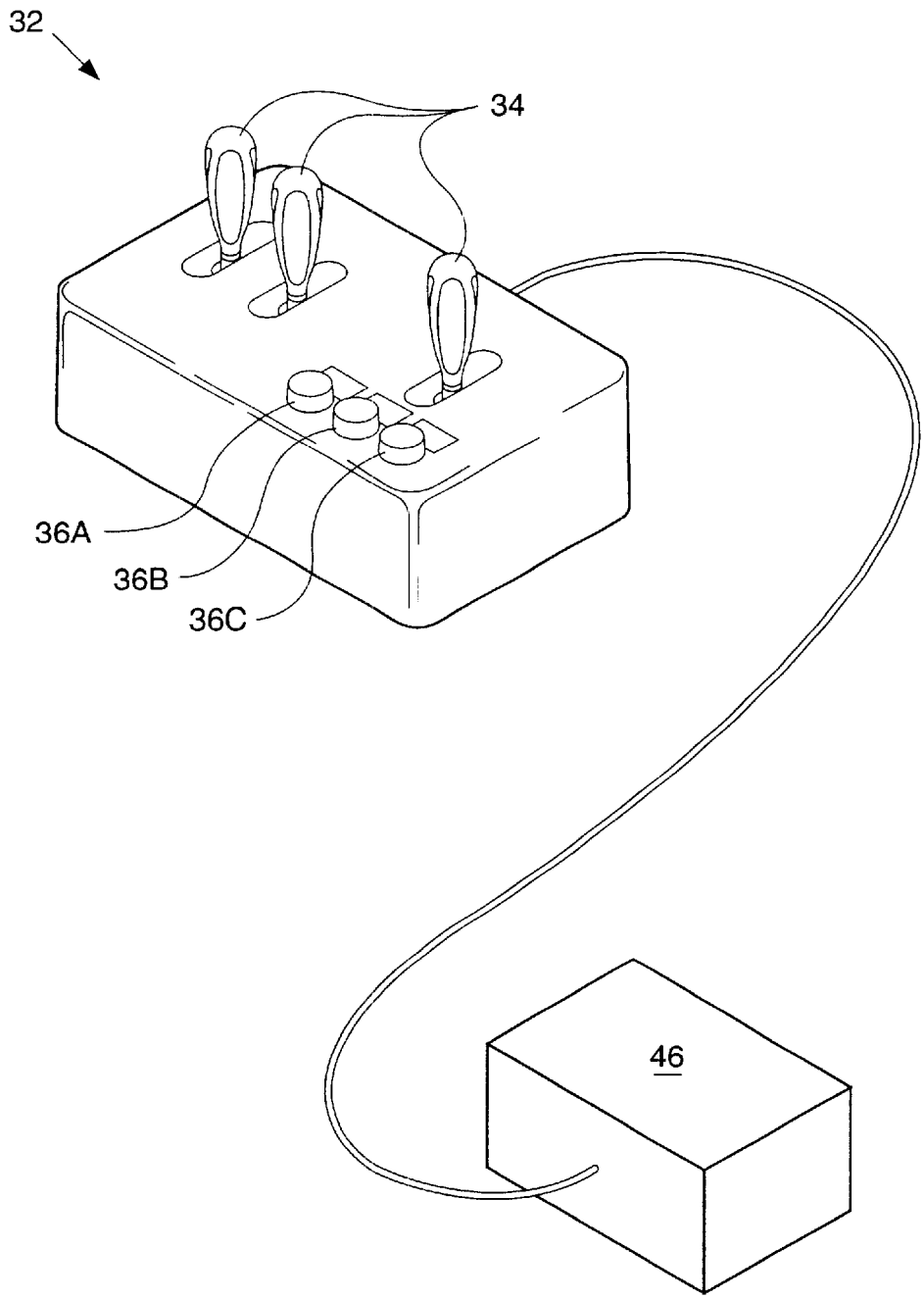
FIG. 3 is a diagrammatic illustration of an operator interface panel designed according to this invention.

As best seen in FIG. 3, the control panel 32 preferably includes at least one operator switch 36. The illustrated embodiment includes three switches 36A, 36B and 36C. Additional switches can be added at any time for other automated work functions. Push button switches are shown as an example of the operator switch that is useful with this invention. Other switches could be utilized such as toggle switches, rocker switches or rotary knobs. The operator switch preferably is a momentary switch that only requires a brief activation by the operator to generate an operator switch signal that is utilized by the controller 46 to carry out an automated work function.

Figure 4:
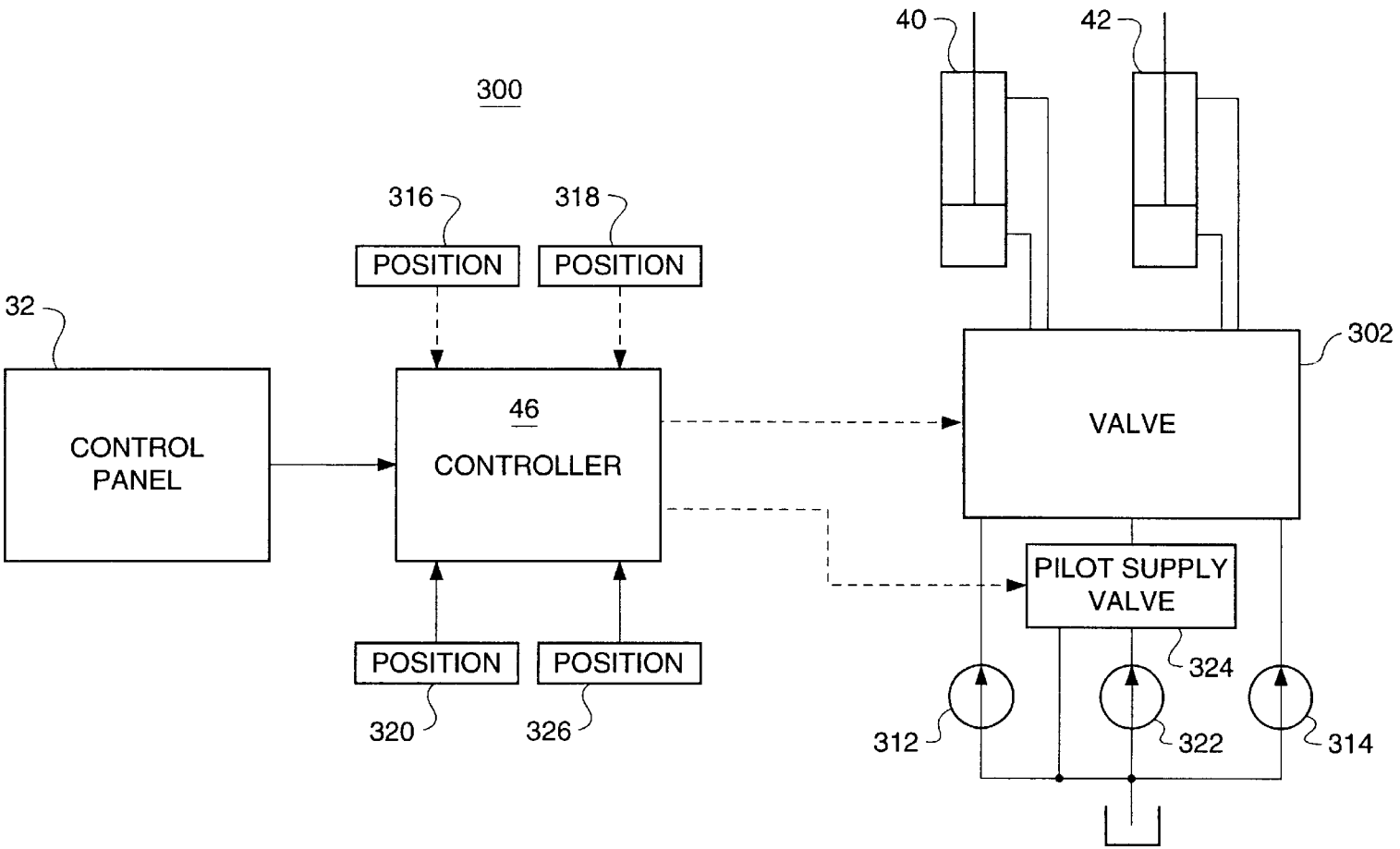
FIG. 4 is a block diagram of an electrohydraulic control system of a work machine.

With reference to FIG. 4, an implement control system 300 of the present invention as applied to a wheel type loader is diagrammatically illustrated. The implement control system is adapted to sense a plurality of inputs and responsively produce output signals which are delivered to various actuators in the control system. Preferably, the implement control system includes a microprocessor-based controlling means 46.

The operator positions levers 34 to control the operation of the hydraulic cylinders in order to manipulate the work attachment 28 and the work implement 22. The operator additionally activates the switches to perform an automated work function. The switches deliver an operator switch signal to the controller 46 which performs calculations and generates a control signal to control the hydraulic cylinders 40,42.

Position sensors 316,318 sense the position of the hydraulic cylinders 40,42 and responsively produce respective cylinder position signals. In one embodiment, the position sensors 316,318 include rotary potentiometers. The rotary potentiometers produce analog signals which are then converted to pulse width modulated signals in response to the angular position of the lift arm 24 with respect to the machine 20 and the work attachment 28 with respect to the lift arm 24. The angular position of the lift arm is a function of the lift cylinder extension 40, while the angular position of the work attachment 28 is a function of both the hydraulic cylinder extensions 40 and 42. The controller 46 receives the respective position signals and calculates the linear position of the respective cylinder. Note that the function of the position sensors 316,318 can readily be any other sensor which is capable of measuring, either directly or indirectly, the relative extension of a hydraulic cylinder. For example, the potentiometers could be replaced with radio frequency (RF) sensors disposed within the hydraulic cylinders. A valve 302 is responsive to control signals produced by the controller and provides hydraulic fluid flow to the hydraulic cylinders 40,42.

A rotary position sensor 320 senses the rotation of the rotary members 123 or rotary track 124 and responsively produces an electrical signal indicative of the amount of rotation. A rotary position sensor 326 senses the rotation of the machine body 216 and responsively produces an electrical signal indicative of the amount of rotation. Such rotary position sensors are well known in the art and need not be further discussed.

The valve 302 may include multiple main valves (for example, two main valves for each of the hydraulic cylinders 40,42) and multiple electrically actuated pilot valves (for example, two pilot or secondary valves for each main valve). The main valves direct pressurized fluid to the cylinders 40,42 and the pilot valves direct pilot fluid flow to the main valves. Each pilot valve is electrically connected to the controller 46. Two main pumps 312,314 are used to supply hydraulic fluid to the main spools, while a pilot pump 322 is used to supply hydraulic fluid to the pilot valves. An on/off solenoid valve and pressure relief valve 324 are included to control pilot fluid flow to the pilot valves.

The controller 46 preferably includes RAM and ROM modules that store software programs to carry out certain features of the present invention. Each software program corresponds to a work function that is used to control the work implement. The work functions include an automatic lift function which extends and retracts the hydraulic cylinders 40,42 to control the bucket height, an automatic dump function which extends and retracts the hydraulic cylinders 40,42 to control the bucket attitude and bucket height, and an automatic return to dig function which extends and retracts the hydraulic cylinders 40,42 to control the bucket attitude and bucket height.

The controller 46 receives the operator switch signals from the control panel 32 and responsively produces control signals to control the respective hydraulic cylinders at a desired velocity. The valve 302 receives the control signals and controllably provides hydraulic fluid flow to the respective hydraulic cylinder in response to the magnitude of the control signals.

The control system of this invention enables an operator to repeatedly complete certain of the work functions by simply activating one of the switches 36A, 36B or 36C, depending on the desired work function.

The automatic work functions available include an auto lift, auto dump, and auto return to dig work function. These functions are used to automatically manipulate the hydraulic cylinders on the linkage to produce the desired results. The auto lift function is used to automatically lift the loader linkage to raise the bucket to a predetermined maximum height. This function is used when the bucket has been filled and the machine is moving toward the desired dumping point. The auto dump function causes the linkage to lift and dump simultaneously to cause a full bucket to pour out the material captured in the bucket. This feature is currently performed manually by the operator, who must manipulate two levers at the same time. The auto return to dig function causes the bucket to rack back while the operator backs the machine away from the dumping area. The controller determines when the machine has backed enough that the bucket is clear of the truck or other dumping receptacle, then the controller automatically lowers the bucket to the ground to facilitate a quick return to a digging position. These work functions will be discussed in greater detail below.

Figure 7:
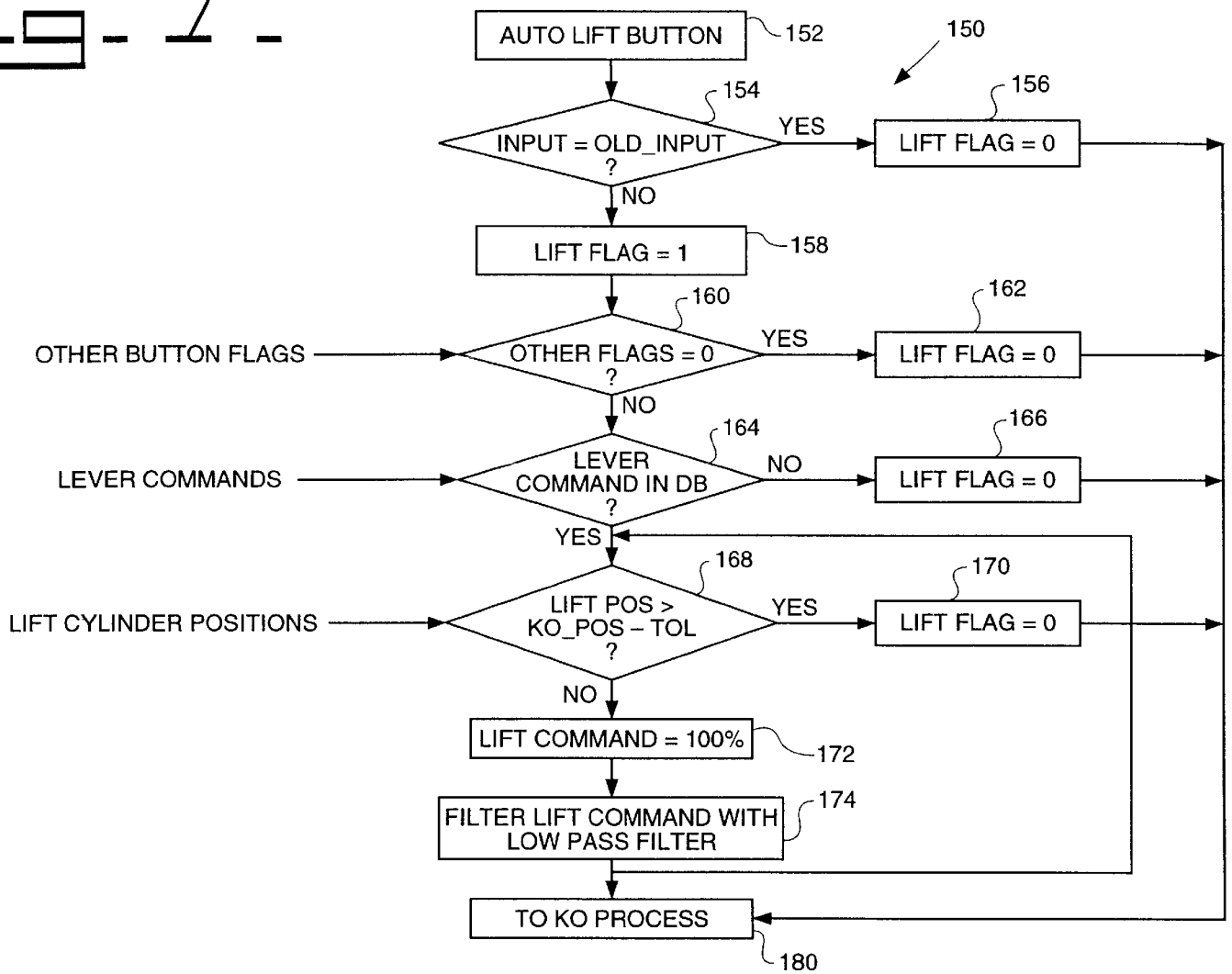
FIG. 7 is a flow chart diagram illustrating a third method of this invention.

FIG. 7 illustrates a flow chart 150 showing the preferred method of performing the automated lift function. When the operator activates the operator switch 36A, for example, an auto lift command is issued at step 152. The controller 46 first determines whether the command is a repeat command at step 154 and, if so, sets the lift flag to a zero or false value at step 156. If this is a new command, the lift flag is set to a true value at step 158. As described above, the controller determines whether other button commands have been issued and are not yet completed at step 160 and, if so, sets the lift flag to a zero or false value at step 162. The controller 46 determines whether any lever commands have been issued by the operator at step 164. If so, the lift flag is set to a zero or false value at step 166.

Once the controller 46 has determined that the conditions are appropriate for performing the automated lift function, the controller determines if the lift position is less than the lift upper kickout position at step 168. If the lift upper kickout position has been reached then the lift flag is set to a zero or false value at step 170. In the event that the lift upper kickout position has not yet been reached then a lift command is issued at step 172. The lift command preferably is filtered using an appropriately selected low pass filter at step 174.

The controller 46 continues to monitor the lift cylinder position and steps 168 through 174 are repeatedly performed until the lift flag is set to a zero or false value. At that point, the kickout process can be performed at step 180. The kickout process is a widely known feature that is a process to bring the work implement (22) to the preset position determined through the use of the work function(s).

The automatic dump function is now described. The machine 30 will be controlled to automatically perform a dumping work function when the switch 36B, for example, is activated by the operator. Upon receiving the operator switch signal from the momentary switch activation, the controller 46 first determines whether the conditions are appropriate for performing the automatic dump function. If the conditions are appropriate, the work implement 22 is manipulated from a current position into the position needed to perform a dump and the dump is completed without requiring the operator to manipulate any of the levers 34.

The method of this invention allows the operator to simply activate the push button switch 36B and the machine will automatically perform the desired dumping function. Since most operators will perform a dump after loading the work attachment 28, it is necessary to lift the work implement from a current position, such as a digging position, into a raised position where the contents of the work attachment 28 can be dumped onto a pile or into a truck, for example. Raising the work implement 22 into an appropriate position prior to dumping the contents of the work attachment 28 requires coordinated movement of the lift arm, 24 bucket link 26, and lever link 27 to ensure that the contents of the bucket are not spilled prematurely. The controller 46 automatically controls the hydraulic cylinders 40, 42 to ensure that the appropriate sequence and timing of movement of each portion of the work implement 22 is performed to accurately and efficiently complete the desired work function, such as an automated dump.

Figure 5A:
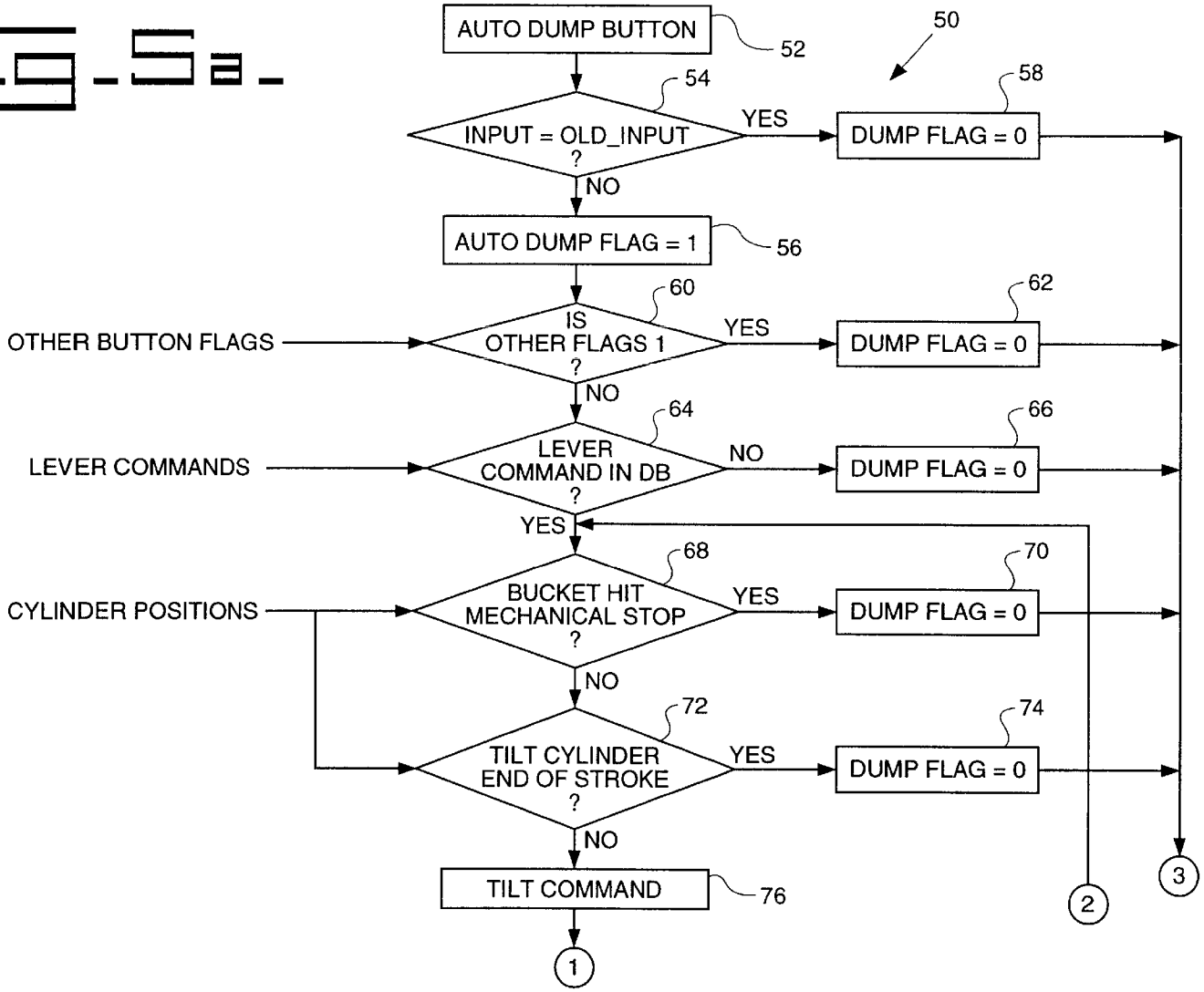
FIGS. 5A and 5B are flow chart diagrams illustrating a first method of this invention.
Figure 5B:
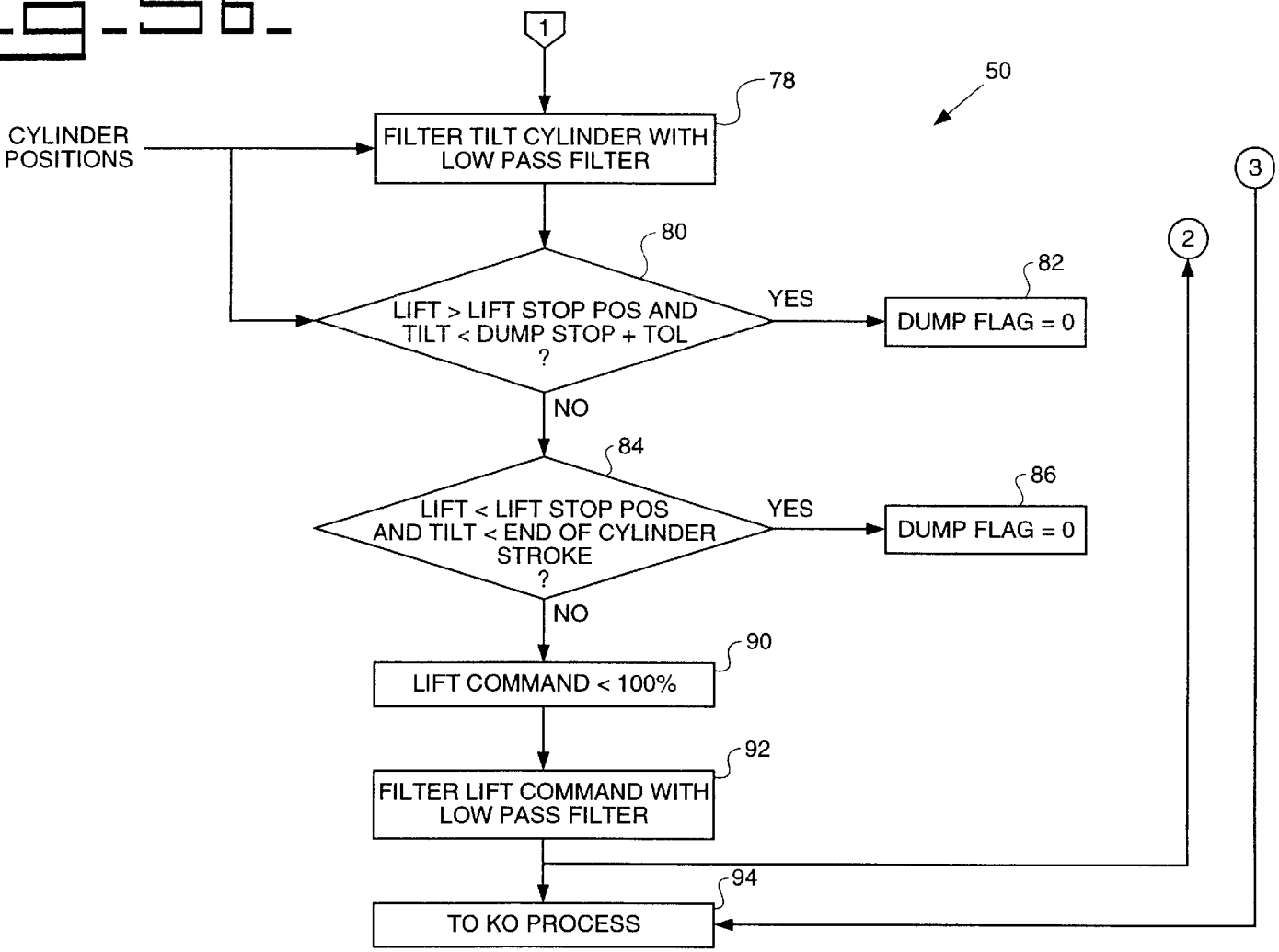
Figure 5A:
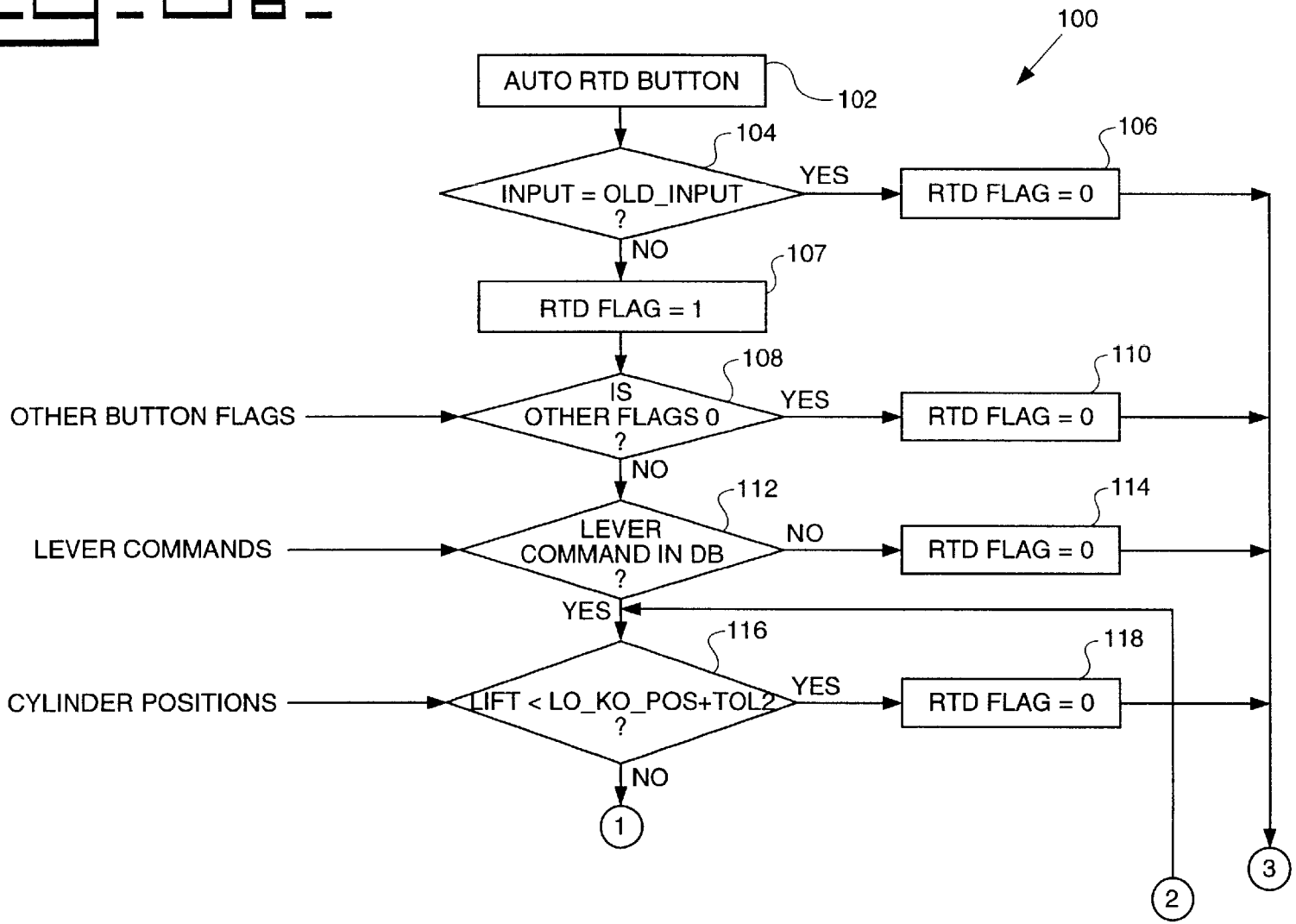

The flow chart 50 in FIGS. 5A and 5B illustrates the preferred strategy for completing an automated dump work function. An operator switch signal is generated at step 52 when the operator activates the switch 36B, for example. The controller 46 preferably first determines at step 54 whether the operator switch signal is a repeat of a previously generated command that has not yet been fully executed. If so, the controller 46 sets the dump flag, which corresponds to a command to raise the work implement 22, to a zero or false value at step 58. If the operator switch signal is a new command, the controller sets the auto dump flag to a positive or true value at step 56. Next, the controller determines whether conditions are appropriate for completing the automated dump work function.

At step 60, the controller determines whether other commands have been generated by activating one of the switches 36A or 36C, for example. If so, the dump flag is set to a zero or false value at step 62. If there are no currently uncompleted commands from one of the momentary operator switches, the controller 46 next determines at step 64 whether any commands are being generated by movement of one of the levers 34.

The controller 46 preferably always responds to lever commands 34 as a priority command over any of the commands generated by activating one of the switches 36. This ensures that the operator can always maintain control over the movement of the work implement 22 to ensure safe operation of the machine. If any lever commands have been issued, the dump flag is set to a zero or false value at step 66. If there are no current lever commands, then the controller 46 continues to determine the current positions of the hydraulic cylinders 40 and 42.

At step 68, the controller determines whether the work attachment 28 has been moved such that it has hit a mechanical stop. If so, the dump flag is set to a zero or false value at step 70. Next, the controller determines whether the tilt cylinder has reached its end of stroke at step 72, if so, the dump flag is set to a zero or false value at step 74. Once the controller 46 has determined that all of the conditions are appropriate for performing the work function indicated by the command generated through the momentary activation of the switch 36A, the dump work function is automatically performed.

At step 76, the initial step in performing the automated dump is to issue the tilt command. The tilt command preferably is filtered using an appropriately selected low pass filter at step 78. At step 80, the controller 46 determines whether the tilt cylinder position is close to a mechanical stop position above a preselected lift height. If so, the dump flag is set to a zero or false value at step 82. This allows for cushioning of the bucket to minimize any dump jerk. At step 84, the determination is made if the tilt cylinder has reached the end of stroke below a certain lift height. If so, the dump flag is set to a zero or false value at step 86. If the auto dump flag is still true (i.e., all conditions are appropriate to complete the automated dump) a lift command of less than 100% is issued at step 90. The lift command preferably is issued at a value less than 100% and preferably is filtered using an appropriately selected low pass filter at step 92. Setting the lift command below 100% is preferred because the lift command should not initiate a lift kickout. Steps 68 through 92 are repeatedly performed until the auto dump flag is set to a zero or false value, which indicates the end of the auto dump function. As indicated by the arrows in the flow chart 50, the next step is to move to the kickout process at step 94.

Figure 6B:
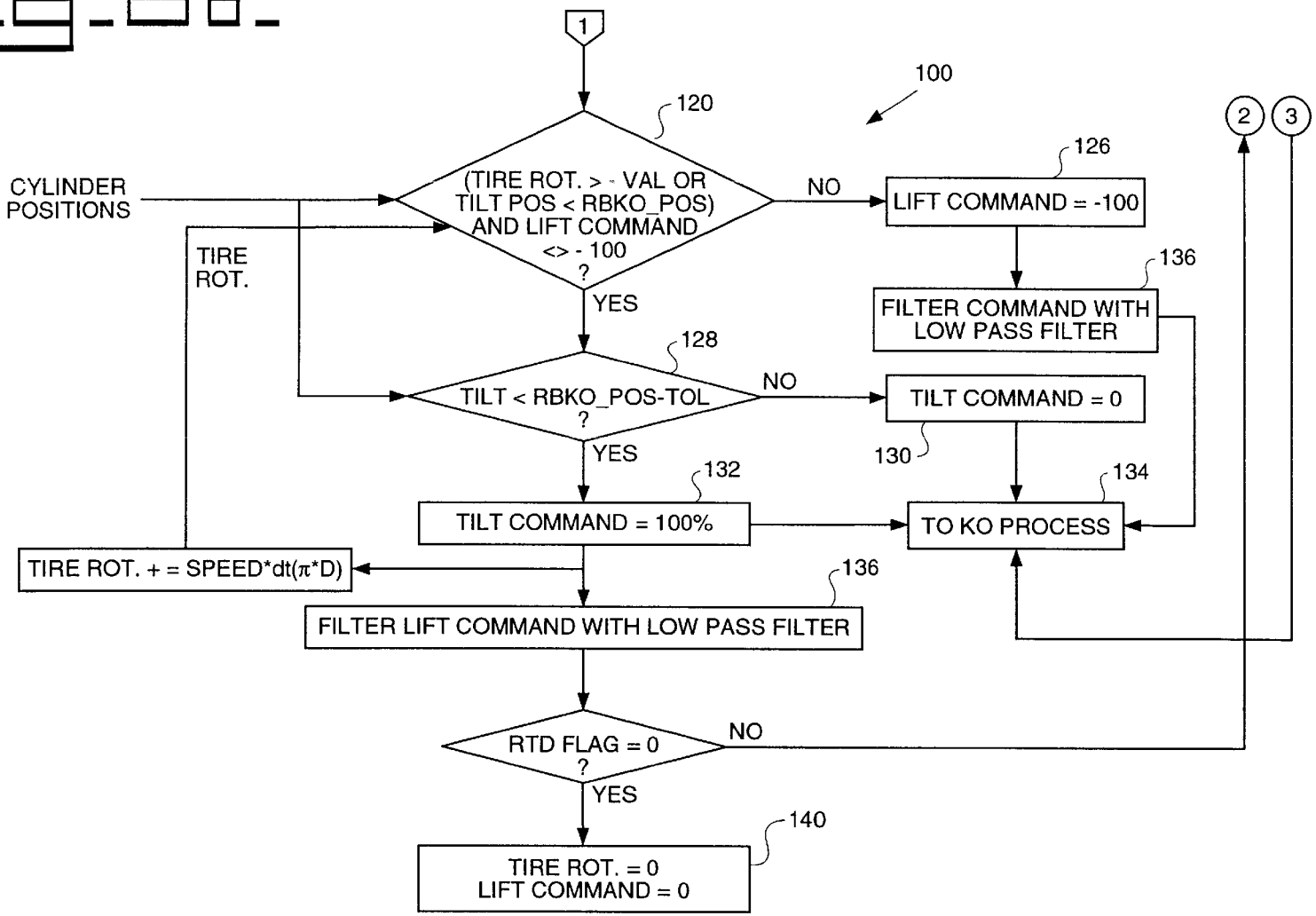

Yet another available automated work function that is performed by the system of this invention is illustrated in flow chart form in FIGS. 6A and 6B. This work function automatically returns the work attachment 28 to a dig position and, therefore, is referred to as an auto return to dig function. The operator preferably requests an auto return to dig function by activating the switch 36C (in the illustrated example). Once the command is received by the controller 46, the work implement 22 will be moved from a raised position back into a position where the work attachment 28 can be in ready position to dig. The sequence of performing a dump and returning the work attachment 28 to a dig position is typically repeated many times by an operator on a job site where relatively large amounts of excavation are performed. By automating these work functions, this invention greatly simplifies the tasks performed by the operator and reduces the operator's experience of fatigue throughout a work day.

The flow chart 100 begins with the operator switch signal being generated at step 102 when the operator activates the switch 36C. The controller 46 first determines at step 104 whether the operator switch signal matches a previous command that has not yet been completed. If so, the return to dig flag is set to a zero or false value at step 106. If this is a new command, the return to dig flag is set to a true value at step 107.

Next, the controller 46 determines whether the conditions are appropriate for performing the automated return to dig operation. At step 108, the controller determines whether other operator switch signals from other operator switches have not yet been executed. If so, the controller sets the return to dig flag to a zero or false value at step 110. If there are no other commands from operator switches that have not been executed, the controller continues on and determines whether any lever commands are outside the deadband at step 112. If so, the return to dig flag is set to a zero or false value at step 114. As described above, any lever commands from the operator preferably take precedence or priority over any commands generated by activating one of the operator switches 36. If there are no lever commands (i.e., the operator is not moving any of the levers 34) then the controller determines if the lift position has reached the lower kick out position at step 116. If so, the return to dig flag is set to false at step 118. This indicates that the return to dig function is complete.

If the return to dig flag is still true, the controller determines whether the machine 20 has moved into a position where it is clear for lowering the work attachment 28 from a raised, dumping position to the dig position. This is determined at step 120 by determining whether the machine 20 has moved sufficiently from a first position or location (i.e., where a dump was performed) to have clearance to return to the dig position. One way of determining this is to determine whether the rotary members 123 or rotary track 124 of the machine have moved in a reverse direction a predetermined amount. This would indicate, for example, that the machine has backed away from a truck sufficiently so that the work attachment 28 can be lowered. If the machine were still in the same position where a dump was performed, the bucket would be lowered down against a truck, for example. Another determination made at step 120 is determining if the tilt position has reached the rackback kickout position, which would indicate that the work attachment 28 is tilted in such a way that the work attachment 28 is at the opposite extreme from the full dump position.

Where the work machine is an excavator, another way of determining whether a machine has moved from a dump position is to monitor the rotation of the body 216 about the axis 122 illustrated in FIG. 2. For example, an excavator is typically used to dig in one position, then to rotate the body 216 into a second position where the contents of the work attachment 202 are dumped. Since a series of digs and dumps can be performed without rotating the tracks 124 (i.e., relocating the machine 200), movement about the axis 122 can be sufficient to indicate that the machine has moved from a dumping position into another position where the work attachment 202 is clear to be returned to the dig position.

If the machine has moved from a dump position, a lift lower kickout command is issued at step 126. This ensures full rackback of the work attachment 28 before the lift arm 24 starts lowering. At step 128, the controller 46 determines if the work attachment 28 has reached the rackback kickout (RBKO) position. If so, then the tilt command is set to zero or a false value at step 130. This ensures that the work attachment 28 stops at the rackback kickout position. Otherwise a tilt rackback kickout command is issued at step 132 to complete the bucket rackback and the kickout process at step 134.

Next, the controller 46 continues to monitor machine position based upon available ground speed information and monitoring of the rotary members 123 or rotary track 124, or monitors rotation of the machine body 200 about the axis 122, depending on what type of machine is being utilized, and continues to perform the steps 120–134 until the return to dig work function is complete. All commands in the automated return to dig function preferably are filtered using an appropriately selected low pass filter as indicated at step 136 to achieve signal smoothness.

Once the return to dig flag is set to a zero or false value, all commands are reset to zero at step 140.

In addition to automatically moving the work implement 22 during the automated return to dig function, the controller 46 can be programmed to cause the machine to move from a current location into another location where the work attachment 28 is clear to be lowered to the dig position. When this feature is utilized, it further automates the return to dig work function. Many operators may choose to have the automated return to dig function only move the work implement 22 and not rotate the machine body 200 or cause the machine wheels to rotate (depending on the particular machine). The control panel 32 preferably includes a switch or other device that enables an operator to choose how much of the automated return to dig function should be performed by the controller 46.

Sometimes the machine 20 is operated to perform simultaneous movements such as a simultaneous raise and dump operation. This can be accomplished by an operator utilizing levers 34 or could be automatically implemented using a single operator switch such as those described above. Under certain conditions, a simultaneous raise and dump operation may result in undesirable vibrations or shaking of the machine 20. It has been found that this occurs when the work implement 22 is moved such that the work attachment 28 is raised above a height indicated by the line 220, for example. Once the work implement 22 reaches this height, the controller 46 preferably begins to filter the tilt operator switch signals in a manner that eliminates or, at least, minimizes any vibration or shaking of the machine 20.

Figure 8:
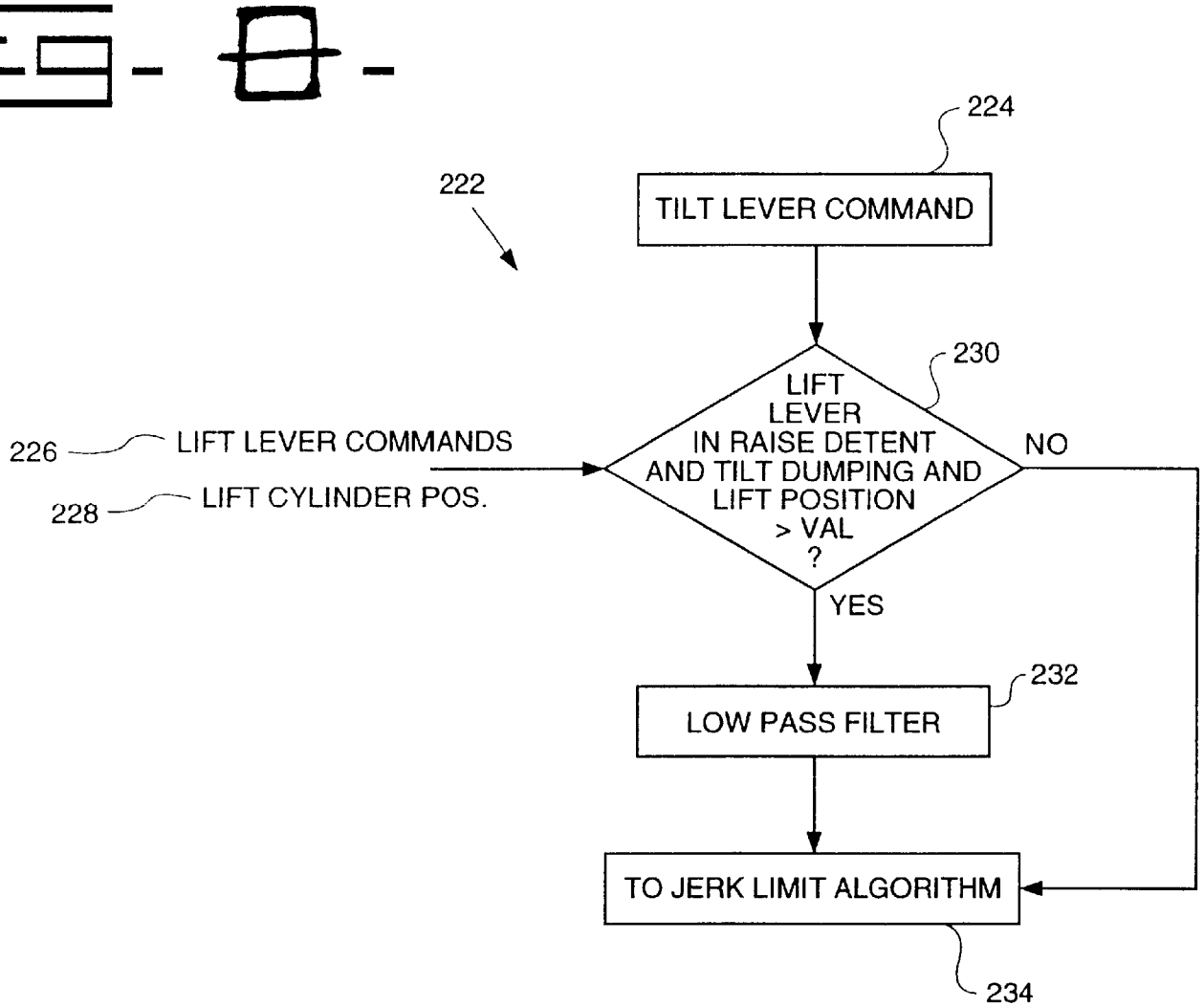
FIG. 8 is a flow chart diagram illustrating another method of this invention.

FIG. 8 illustrates the preferred methodology to stabilize the machine 20 during a simultaneous raise and dump work function. The flow chart 222 illustrates that the controller 46 receives information including a tilt lever operator switch signal 224, a lift lever operator switch signal 226 and lift cylinder position information 228. This information is utilized to determine whether the lift lever, tilt dumping and lift position indicate that the work implement 22 has moved to a position such that the work attachment 28 is above the predetermined height 220. Once this condition is met, the operator switch signals preferably are filtered using an appropriately selected low pass filter at step 232. The system then proceeds to a conventional jerk limiting algorithm at step 234.

By filtering the operator switch signals during the simultaneous raise and dump operation, whether those operator switch signals are generated automatically or by an operator manipulating levers, stabilizes the work machine. This is especially useful when the operator utilizes levers because any vibration or shaking of the machine will result in the operator shaking the levers, which in turn exacerbates the shaking problem.

Industrial Applicability

The system and methods of this invention are particularly useful for automating work functions that are performed repeatedly with a work machine. The operator's task of operating the machine is simplified and rendered more efficient by automating one or more work functions as described above. Utilizing a single, preferably momentary, operator switch to begin and complete an automated work function not only simplifies the task of the operator but also enhances the efficiency of the work machine. The various components of the work implement 28, such as the work attachment 22 and lift arm 24, that are moved throughout a particular work function are controlled in a sequence and at a speed that maximizes the efficiency of the work machine and reduces wear on the various components.

Given the above description, those skilled in the art will realize that the control system and methods of this invention greatly enhance an operator's ability to perform necessary work functions in a more efficient, less fatiguing manner.

The description given above provides example implementations of this invention. Variations and modifications may become apparent to those skilled in the art that do not necessarily depart from the basis of this invention. The scope of legal protection given to this invention can only be determined by studying the following claims.

What is claimed is:

1. A system for controlling a work machine having a work implement, comprising:

an operator interface having at least one operator switch that is selectively activated to generate an operator switch signal indicative of a desired work function and a plurality of levers that are manually moveable to generate operator lever signals to control movement of the work implement;

at least one position sensor that generates a position signal to indicate the position of the work implement; and a controller that receives the operator switch, operator lever, and position signals, determines the position of the work implement and produces a control signal to control the movement of the work implement and automatically perform the desired work function in response to a single activation of the operator switch.

2. The system of claim 1, wherein the controller overrides the operator switch signal in response to an operator lever signal being generated.

3. The system of claim 1, including a plurality of operator switches, each corresponding to a unique work function.

4. The system of claim 1, wherein the desired work function includes returning the work implement to a dig position, wherein the controller determines that the work machine has moved a minimum amount from a first location in at least one preselected direction and producing a control signal to cause the work implement to automatically return to a dig position.

5. The system of claim 4, wherein the work machine includes rotary members or a rotary track that rotate to move the machine between locations, the controller determining that the rotary members or rotary track has rotated a desired amount in a reverse direction.

6. The system of claim 1, wherein the desired work function includes moving the work implement to an uppermost limit of travel.

7. The system of claim 1, wherein the work implement includes a work attachment and the desired work function includes simultaneously lifting the work implement and tilting the work attachment to dump the contents of the work attachment.

8. The system of claim 1, wherein the work implement includes a work attachment and the controller determines when the work implement is in an orientation that places the work attachment within a predetermined range of positions and the controller modifies an operator switch signal to continue moving the work implement whenever said work attachment is located within the predetermined range of positions.

9. The system of claim 1, wherein the operator switch includes a push button.

10. A method of controlling a work machine having a work implement, at least one operator switch, and a plurality of levers, comprising the steps of:

(A) activating the operator switch to generate a signal indicative of a desired work function;

(B) determining the position of the work implement; and (C) automatically moving the work implement from the current position to a predetermined position to perform the desired work function in response to a single activation of the operator switch.

11. The method of claim 10, including the steps of determining whether the signal from step (A) is the same as a previously generated signal, determining whether a previous signal has been generated prior to performing step (A) and a work function corresponding to the previous signal has not yet been completely performed.

12. The method of claim 10, including the step of interrupting the performance of step (C) whenever a machine operator moves one of the levers.

13. The method of claim 10, including the steps of moving the work implement from a current position to a dig position in response to the machine being in a first location and the work machine being moved a minimum distance from the first location.

14. The method of claim 10, wherein the work machine includes rotary members for propelling the machine along a ground surface, and including the step of determining an amount of rotation of the rotary members and automatically returning the work implement to a dig position.

15. The method of claim 10, wherein the desired work function includes the step of moving the work implement to an uppermost limit of travel.

16. The method of claim 10, wherein the work implement includes a work attachment and the desired work function includes the steps of simultaneously lifting the work implement and tilting the work attachment to dump the contents of the work attachment.

17. A method of controlling a work machine having at least one operator switch, a plurality of levers, and a work attachment that is supported by a plurality of links, the work attachment being moveable relative to the links, comprising the steps of:

(A) activating the operator switch to generate a signal indicative of a desired work function;

(B) determining when one or more of the links and work attachment are moving simultaneously;

(C) determining when the work attachment is positioned within a predetermined range of positions; and (D) automatically moving the plurality of links to perform the desired work function in response to a single activation of the operator switch and the work attachment being within the range of step (C).

18. The method of claim 17, including the steps of moving one of the plurality of levers to generate a lever signal, overriding the operator switch signal, controlling the movement of the plurality of links in response to the movement of the control lever, and filtering the operator switch signals at a preselected frequency.

19. A system for controlling a work machine having a plurality of rotary members that propel the machine, a work implement that includes a lift arm, a bucket link, a lever link, hydraulic cylinders, and a work attachment, and a body portion which supports the work implement and an operator compartment having a control panel that includes a plurality of levers and operator switches, comprising:

at least one position sensor that generates a position signal to indicate the position of the work implement;

a controller that receives the operator switch, lever, and position signals, determines the position of the work implement and produces a control signal in response to a single activation of the operator switch; and a valve that receives the control signal and controllably provides hydraulic fluid flow to the appropriate hydraulic cylinders to automatically control the movement of the work implement to automatically perform a desired work function.

20. The apparatus of claim 19, wherein the desired work function includes moving the work attachment to a position where the work attachment is positioned at an uppermost limit of travel.

21. The apparatus of claim 19, wherein the desired work function includes simultaneously lifting the lift arm and pivoting the work attachment to dump the contents of the work attachment.

22. The apparatus of claim 19, wherein the desired work function includes returning the work implement to a dig position, wherein the controller determines that the work machine has moved a minimum amount from a first location in at least one preselected direction and producing a control signal to cause the work implement to automatically return to a dig position.

* * * * *